United States Patent [19]

Ayres

[11] 4,253,981

[45] Mar. 3, 1981

[54] VISCOUS LUBRICANT COMPOSITION COMPRISING MIXED ESTERS AND A SILICONE OIL

[75] Inventor: Peter J. Ayres, Norwich, N.Y.

[73] Assignee: Morton-Norwich Products, Inc., Norwich, N.Y.

[21] Appl. No.: 54,666

[22] Filed: Jul. 5, 1979

[51] Int. Cl.[3] ..... C10M 1/10

[52] U.S. Cl. ..... 252/49.6; 252/56 S

[58] Field of Search ..... 252/49.6, 56 S

[56] References Cited

U.S. PATENT DOCUMENTS

| | | | |
|---|---|---|---|
| 3,053,768 | 9/1962 | Cupper | 252/56 S X |
| 3,278,586 | 10/1966 | Ovist | 252/56 S X |
| 3,337,457 | 8/1967 | Fowler et al. | 252/56 S X |
| 3,360,465 | 12/1967 | Warman | 252/56 S |
| 3,860,522 | 1/1975 | Fischer et al. | 252/56 S |
| 4,049,563 | 9/1977 | Burrous | 252/49.6 X |

OTHER PUBLICATIONS

Barnes et al., "Synthetic Ester Lubricants", pp. 454–458, Aug. 1957, Lubrication Engineering.

Larsen et al., "Functional Selection of Synthetic Lubricants", vol. 42. No. 12, Industrial & Eng. Chemistry.

*Primary Examiner*—Andrew Metz

*Attorney, Agent, or Firm*—Anthony J. Franze

[57] ABSTRACT

A viscous composition capable of substantially retaining its viscosity within a temperature range of from 5°–30° C. comprising as its components diisopropyl adipate, a mixture of cetyl and stearyl octanoates, glyceryl tribehenate, silicone oil and a surfactant is described.

1 Claim, No Drawings

VISCOUS LUBRICANT COMPOSITION COMPRISING MIXED ESTERS AND A SILICONE OIL

This invention is concerned with the provision of a viscous composition adapted to be used as a lubricant, surface protectant, moisture repelling agent, carrier for additives, or as a means for supplying agents for topical application. More particularly among the objects of this invention is the provision of a viscous composition whose manufacture is relatively simple, economical, and requires minimal space and machinery. Additionally, it is an object of this invention to provide such viscous preparation having substantially no tendency toward separation of ingredients and having the ability to retain its viscosity over a range of temperatures outside of those ordinarily encountered in vehicles used for topical application.

In accordance with the foregoing objects and desiderata I have discovered that a composition comprising a mixture of diisopropyl adipate, octanoic acid esters such as cetyl and stearyl, glyceryl tribehenate, a silicone oil and a surfactant possesses the aforesaid properties and characteristics and in addition exhibits pseudoplastic behavior.

In the practice of my invention I prefer that diisopropyl adipate and the mixture of cetyl and stearyl octanoates, sometimes referred to as purcellin oil, constitute the bulk of the composition, being present in the amount from 79–92% of its total weight. The silicone oil, having a viscosity of from 5-1000 cps, provides from 2.5–10% of the composition. The triglyceride, glyceryl tribehenate, may be present at a level from 5–15% but preferably 10% and a nonionic surfactant having a hydrophile-lipophile balance from 1.8–4 but preferably 4 at a level of 0.2–1.5% but preferably 0.5% makes up the remainder.

Representative formulae are the following:

EXAMPLE 1

| | % |
|---|---|
| Diisopropyl Adipate | 20.0 |
| Purcellin Oil | 59.5 |

-continued

| | % |
|---|---|
| Glyceryl Tribehenate | 10.0 |
| Silicone Oil 100 cps | 10.0 |
| Surfactant (88% Sorbitan Monooleate + 12% Sorbitan Trioleate). | 0.5 |

EXAMPLE 2

| | % |
|---|---|
| Diisopropyl Adipate | 20.0 |
| Purcellin Oil | 64.5 |
| Glyceryl Tribehenate | 10.0 |
| Silicone Oil 100 cps | 5.0 |
| Surfactant (88% Sorbitan Monooleate + 12% Sorbitan Trioleate). | 0.5 |

Viscosity measurements using a Brookfield Viscometer Model LV, spindle T-A on the composition of Example 1 at different temperatures were:

| Temp. °C. | Viscosity cps |
|---|---|
| 30° | 28,000 |
| 24° | 30,000 |
| 10° | 32,000 |
| 5° | 30,000 |

The preparation of the compositions of my invention is described as follows; temperatures are in Celsius.

The components are melted at a temperature of 65–70° and stirred until homogenous. The mixture is then rapidly cooled with vigorous stirring until the temperature is below 12°. Preferably between 8° and 10°. The preparation is passed through a conventional spring jet homogeniser. Any conventional homogenisation method may be used providing the temperature is kept between 8° and 10°.

What is claimed is:

1. A composition comprising (a) a mixture of diisopropyl adipate 20% and purcellin oil 59.5–64.5%; (b) glyceryl tribehenate 5–15%; (c) silicone oil of viscosity 5–1000 cps 2.5–10% and (d) a surfactant comprising 88% sorbitan monooleate and 12% sorbitan trioleate 0.2–1.5%.

* * * * *